United States Patent [19]

Kato et al.

[11] Patent Number: 4,606,567

[45] Date of Patent: Aug. 19, 1986

[54] DOOR LATCH OPERATING DEVICE

[75] Inventors: Yuichi Kato, Tokyo; Ichiro Okamoto, Sagamihara, both of Japan

[73] Assignees: Nissan Motor Co., Ltd.; Ohi Seisakusho Co., Ltd., both of Yokohama, Japan

[21] Appl. No.: 546,135

[22] Filed: Oct. 27, 1983

[30] Foreign Application Priority Data

Nov. 2, 1982 [JP] Japan ..... 57-191801

[51] Int. Cl.[4] ..... E05C 13/00

[52] U.S. Cl. ..... 292/336.3; 292/DIG. 38; 292/1

[58] Field of Search ..... 292/139, 167, 336.3, 292/347, 1, DIG. 38

[56] References Cited

U.S. PATENT DOCUMENTS

| | | | |
|---|---|---|---|
| 202,186 | 4/1878 | Montgomery | 292/139 |
| 1,605,989 | 11/1926 | Rucker | 292/167 X |
| 2,534,693 | 12/1950 | Adams | 292/DIG. 31 |
| 3,918,754 | 11/1975 | Isbister | 292/DIG. 38 X |
| 4,083,589 | 4/1978 | Palmerino | 292/336.3 |
| 4,099,757 | 7/1978 | Palmer et al. | 292/336.3 |

FOREIGN PATENT DOCUMENTS

| | | |
|---|---|---|
| 50-1226 | 1/1975 | Japan . |
| 54-13693 | 6/1979 | Japan . |

*Primary Examiner*—Richard E. Moore

*Attorney, Agent, or Firm*—Schwartz, Jeffery, Schwaab, Mack, Blumenthal & Evans

[57] ABSTRACT

Herein disclosed is a door latch operating device which comprises a stationary member fixed to the door, a first movable member movable from a first position to cause the door to be locked to a second position to cause the door to be unlocked, a second movable member hingedly connected to the stationary member, and a third movable member having one end hingedly connected to the leading end of the second movable member and the other end pivotally connected to the first movable member. With this arrangement, the movement of the second movable member induces the movement of the first movable member, and vice versa.

11 Claims, 5 Drawing Figures

DOOR LATCH OPERATING DEVICE

BACKGROUND OF THE INVENTION

1. Field of the Invention

The present invention relates in general to a door latch system which latches a door to a fixed member, and more particularly to a door latch operating device which operates the system to assume its door lock or door unlock condition.

2. Description of the Prior Art

In the field of the door latch operating device, there has been proposed a so-called dual knob type operating device which makes it difficult for a thief to open the door from outside. One of the conventional dual knob type operating devices is disclosed in U.S. Pat. No. 4,083,589, which comprises generally a first button slidably mounted in the door for vertical movement from its lowermost lock position to its uppermost unlock position, a second button slidably mounted in the door for horizontal movement from an outer inoperative position to an inner operative position, and a wedge body mounted on the second button and provided with an inclined surface which is slidably engaged with the first button to move it from the lowermost lock position to the uppermost unlock position, and vice versa.

However, since this conventional dual knob type operating device is constructed without taking a deeper consideration on compactness thereof, the device produced has a considerable thickness. Thus, upon assembly to the door, the device is considerably projected into the vehicle cabin thereby reducing the effective space of the same.

SUMMARY OF THE INVENTION

Therefore, it is an essential object of the present invention to provide a compact or thinner dual knob type operating device which is free of the above-mentioned drawback.

It is another object of the present invention to provide a dual knob type operating device which is simple in construction, and inexpensive to manufacture.

According to the present invention, there is provided a door latch operating device for operating a door latch device to lock or unlock a door relative to a fixed member, the door latch operating device comprising a stationary member fixed to the door, a first movable member movable relative to the stationary member, the first movable member being movable from a first position to cause the door latch device to assume its door lock condition to a second position to cause the door latch device to assume its door unlock condition, a second movable member hingedly connected to the stationary member, and a third movable member having one end hingedly connected to the leading end of the second movable member and the other end pivotally connected to the first movable member, so that the movement of the second movable member induces the movement of the first movable member, and vice versa.

BRIEF DESCRIPTION OF THE DRAWINGS

Other objects and advantages of the present invention will become apparent from the following description when taken in conjunction with the accompanying drawings, in which.

DETAILED DESCRIPTION OF THE INVENTION

Figure 1:
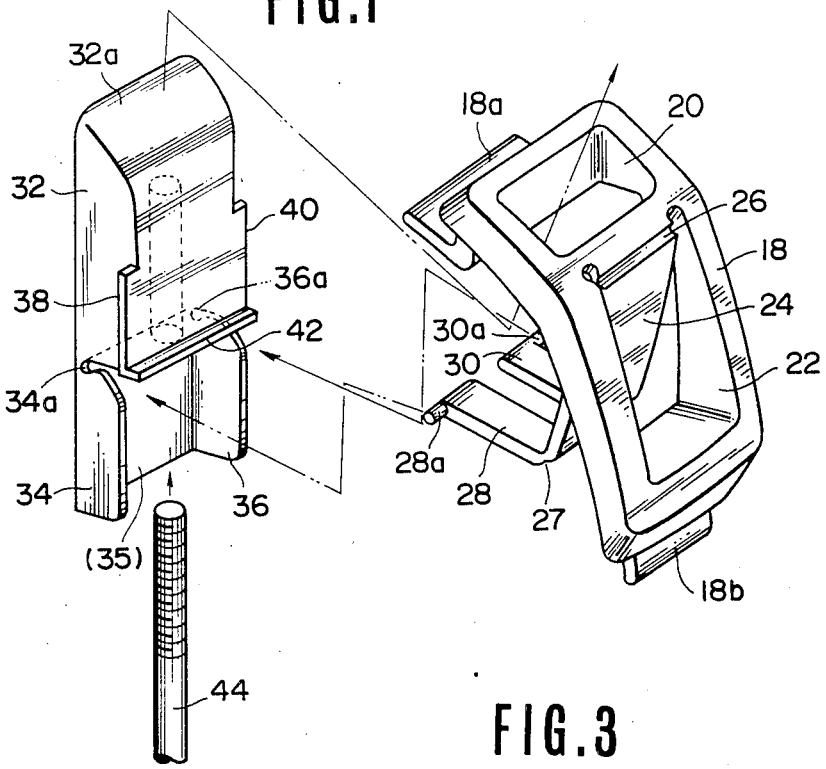
FIG. 1 is an exploded view of a door latch operating device of a first embodiment of the present invention.
Figure 2:
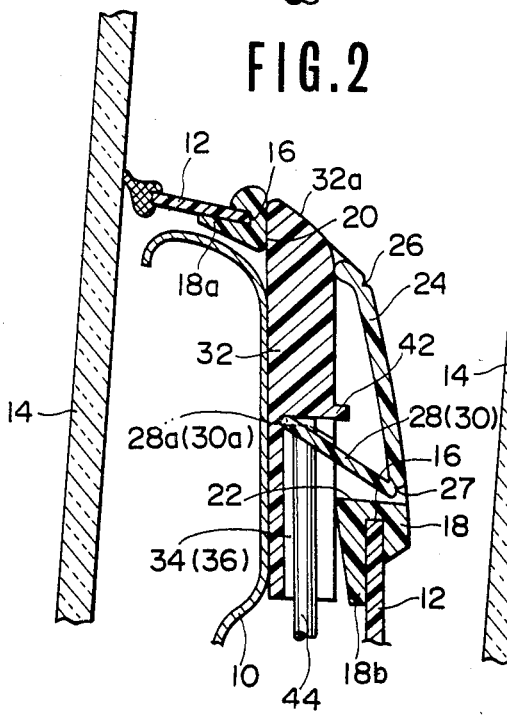
FIG. 2 is a vertically sectional view of the device of the first embodiment in the "lock" position.
Figure 3:
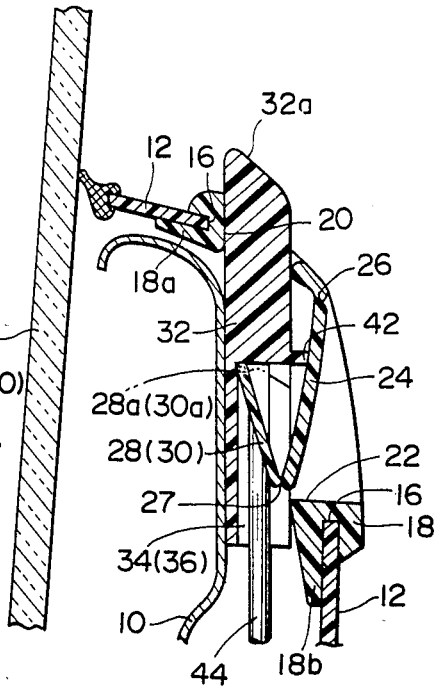
FIG. 3 is a view similar to FIG. 2, but showing the "unlock" position of the device.

Referring to FIGS. 1 to 3 of the drawings, there is shown a door latch operating device of a first embodiment of the invention. As is seen from FIGS. 2 and 3, the door latch operating device is mounted on an automotive door. The door herein shown comprises a door inner panel 10, a door outer panel (not shown), a door trim 12 covering over the inner panel 10 with a suitable space therebetween, and a window pane 14 extending upwardly between the inner panel 10 and the outer panel.

The door latch operating device is mounted on the upper portion of the door trim 12. For this, the door trim 12 is formed at its upper shoulder portion with a rectangular aperture 16. The door latch operating device comprises an escutcheon 18 of plastic which is tightly fitted to the rectangular aperture 16 with its upper and lower grooved portions 18*a* and 18*b* gripping the edges of the aperture 16. The escutcheon 18 is formed at its upper inclined portion with a rectangular opening 20 through which the after-mentioned locking knob (32) is slidably received. The escutcheon 18 is further formed at its lower portion with another rectangular opening 22. As is best seen from FIG. 1, a flat plate 24 extends downward from the upper edge of the opening 22 and is swingable relative to the escutcheon 18. For achieving this swingable movement, the joint portion 26 between the flat plate 24 and the escutcheon 18 is reduced in thickness to act as a hinge. A pair of arms 28 and 30 extend from the spaced leading ends of the flat plate 24 and are swingable relative to the flat plate 24. For this swingable movement, the joint portion 27 between each arm 28 or 30 and the flat plate 24 is reduced in thickness to act as a hinge. Each arm 28 or 30 is formed at its leading end with an outward pin 28*a* or 30*a*. It is to be noted that the escutcheon proper 18, the grooved upper and lower portions 18*a* and 18*b*, the swingable flat plate 24, the swingable arms 28 and 30 are of a one-piece construction of plastic. As will become apparent as the description proceeds, the swingable flat plate 24 acts as an unlocking knob.

As is seen from FIG. 1, the locking knob 32 is formed at its lower portion with two spaced side walls 34 and 36 each having at its upper section a slit 34*a* or 36*a* of which leading end is enlarged and rounded. Upon assembly, the above-mentioned two pins 28*a* and 30*a* of the arms 28 and 30 are pivotally received in the enlarged sections of the slits 34*a* and 36*a* respectively so that the movement of the locking knob 32 causes a synchronous movement of the flat plate 24 and vice versa. As is seen from FIGS. 2 and 3, the locking knob 32 is upwardly and downwardly movably received in the space defined between the door inner panel 10 and the door trim 12 with its upper portion slidably held in the opening 20 of the escutcheon 18. The upper portion of the knob 32 has an inclined surface 32*a* which becomes flush with the outer surface of the inclined upper portion of the escutcheon 18 when the knob 32 is in its lowermost position (that is in the "lock" position), as is seen from FIG. 2. As shown in FIG. 1, the locking knob 32 is formed with two shoulder portions 38 and 40 which are engageable with the frame of the escutcheon 18 to limit the upward movement of the knob 32. The knob 32 is further formed with a flange 42 which is engageable with the back surface of the swingable flat plate 24 to limit the outward movement (that is, the leftward movement in the drawings) of the plate 24, as is seen from FIG. 3. A control rod 44 is threadedly connected to the locking knob 32, which rod extends to a known door latch device (not shown) mounted in the door. The door latch device locks the door when the locking knob 32 is in its lowermost position as shown in FIG. 2, and unlocks the door when the locking knob 32 is in its uppermost position as shown in FIG. 3.

The flat plate 24 and each arm 28 or 30 are so sized and constructed that upon assembly, they define therebetween an acute angle irrespective of the angular positions which the flat plate 24 assumes during its functional operation. In other words, the acute angular relationship between the flat plate 24 and each arm 28 or 30 is maintained even when the locking knob 32 moves from its lowermost position (that is the "lock" position) to its uppermost position (that is the "unlock" position). This means that the movement of the locking knob 32 from its lowermost or "lock" position (FIG. 2) to its uppermost or "unlock" position (FIG. 3) can be carried out by only pressing the flat plate 24 leftward in FIG. 2, and means that pressing the locking knob 32 to move the same from its "unlock" position (FIG. 3) to its "lock" position (FIG. 2) causes the flat plate 24 to move from its depressed position (FIG. 3) to its raised position (FIG. 2). Preferably, the flat plate 24 is so sized and constructed that it becomes flush with the outer surface of the lower portion of the escutcheon 18 when it assumes the raised position, as is understood from FIG. 2.

In the following, operation will be described with reference to FIGS. 2 and 3. For ease with which the explanation is carried out, the description will be commenced with respect to the "lock" condition of the door latch device (not shown). In this lock condition, the locking knob 32 is in its lowermost or lock position as shown in FIG. 2. The inclined upper surface 32*a* of the knob 32 is flush with the outer surface of the escutcheon 18 so that it is impossible to raise it by lifting up on its upper end. The flat plate or unlocking knob 24 assumes its raised position.

When unlocking the door is required, the unlocking knob 24 (that is the flat plate) is depressed with a finger or fingers of an operator. With this, the unlocking knob 24 is swung from the raised position as shown in FIG. 2 to the depressed position as shown in FIG. 3, moving the arms 28 and 30 to lift up the locking knob 32 to its uppermost or unlock position as shown in FIG. 3. Thus, the door becomes unlocked. Now, it is to be noted that provision of the shoulder portions 38 and 40 and the flange 42 on the locking knob 32 suppresses the excess movements of the knobs 32 and 24.

When the locking knob 32 is depressed for locking the door again, the unlocking knob 24 returns in the reversed manner to its raised position as shown in FIG. 2.

Figure 4:
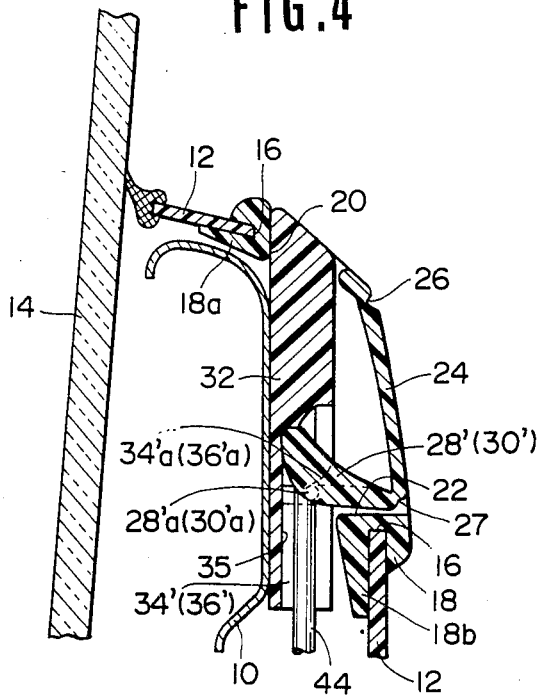
FIG. 4 is a vertically sectional view of a door latch operating device of a second embodiment of the present invention.
Figure 5:
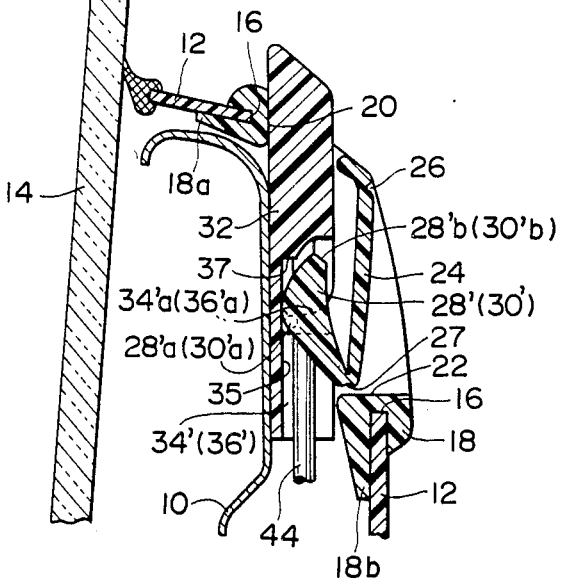
FIG. 5 is a view similar to FIG. 4, but showing the "unlock" position of the device.

Referring to FIGS. 4 and 5, there is shown a second embodiment of the present invention. For facilitation, substantially the same parts as those of the afore-mentioned first embodiment are designated by the same numerals and detailed description of them will be omitted from the following in which only the parts and construction different from those of the first embodiment are described.

In the second embodiment, the arms 28' and 30' extending from the flat plate (unlocking knob) 24 are somewhat thicker than the arms 28 and 30 of the first embodiment, as is understood from the drawings. Each arm 28' or 30' has a convex outer surface which is slidably engageable with the bottom wall 35 (see FIG. 4) which lies between the two spaced side walls 34' and 36' formed at the lower portion of the locking knob 32. The leading end 28'*b* or 30'*b* of each arm 28' and 30' forms a free end which is slidably engageable with the upper wall 37 (see FIG. 5) defined between the major thicker portion of the locking knob 32 and the side-walled portion of the same. Each of the arms 28' and 30' is formed with an outward pin 28'*a* or 30'*a* at its middle portion near the convex outer surface. The two spaced side walls 34' and 36' are formed at their generally middle portions with aligned slits 34'*a* and 36'*a* into which the above-mentioned outward pins 28'*a* and 30'*a* are inserted under a certain condition of the arms 28' and 30'.

In the "lock" condition of the door latch device (not shown), the locking knob 32 and the unlocking knob 24 (that is the flat plate) assume the positions as shown in FIG. 4. Under this condition, the free end 28'*b* or 30'*b* of each arm 28' or 30' is in engagement with the upper wall 37 of the locking knob 32.

When, for unlocking the door, the unlocking knob 24 is depressed with the operator's finger or fingers, the free ends 28'*b* and 30'*b* of the arms 28' and 30' move up the locking knob 32 until the ends 28'*b* and 30'*b* disengage from the upper wall 37 of the knob 32 due to the swingable movement of the arms 28' and 30'. At the time of this disengagement, the outward pins 28'*a* and 30'*a* of the arms 28' and 30' are brought into engagement with the slits 34'*a* and 36'*a* of the side walls 34' and 36', so that after this, the upward movement of the locking knob 32 is effected by the pins 28'*a* and 30'*a* moving together with the arms 28' and 30', and finally, the locking knob 32 comes to its uppermost or unlock position as shown in FIG. 5. Thus, the door becomes unlocked. It is now to be noted that during this operation, the contact point of the convex surface of the each arm 28' or 30' to the bottom wall 35 moves downward keeping the angle defined between the plane of the bottom wall 35 and an imaginary plane which contains both the axis of the hinge portion 27 and the contact point at about 45 degrees. Thus, according to the second embodiment, the movement of the unlocking knob 24 is efficiently transmitted to the locking knob 32 to raise the same. Furthermore, the force required to the unlocking knob 24 for raising the locking knob 32 is kept generally constant for the time the unlocking knob 24 is pressed, so that the handling feeling of the knob 24 is improved as compared with the afore-mentioned first embodiment.

When, for locking the door, the locking knob 32 is depressed, the parts of the locking knob 32 and the unlocking knob 24 move in the reversed manner to return the unlocking knob 24 to its raised position as shown in FIG. 4.

As is understood from the foregoing description, according to the present invention, there is provided a measure in which, for transmitting the movement of one operating knob to the other operating knob and vice versa, a swingable arm (28, 30, 28' and 30') is employed which is hingedly connected to one of the knobs and arranged with respect to the knob to always define therebetween an acute angle. It is to be noted that the acute angle arrangement between the swingable arm and the flat knob (that is the unlocking knob) allows a reduction in thickness of the door latch operating device. Thus, the aforementioned drawback encountered in the conventional dual knob type operating device is solved in the present invention.

What is claimed is:

1. A door latch operating device locking and unlocking a door relative to a fixed member, comprising:

a stationary member secured to the door;

a first movable member movable relative to said stationary member between a first position to cause the door latch device to assume its door lock condition and a second position to cause the door latch device to assume its door unlock condition;

a second movable member having one end hingedly connected to said stationery member; and a third movable member having one end hingedly connected to the other end of said second movable member and having the other end pivotally connected to said first movable member, so that the movement of said second movable member induces the movement of said first movable member, and vice versa;

wherein said third movable member is arranged with respect to said second movable member to always define therebetweeen an acute angle; and wherein said first movable member is formed with first and second stopper members, said first stopper member being brought into engagement with said stationary member to suppress its excess movement beyond the second position thereof, said second stopper member being brought into engagement with said second movable member to suppress the excess movement of said second movable member in a direction to cause said first movable member to move from said first position to said second position.

2. A door latch operating device as claimed in claim 1, in which said stationary member, said second movable member and said third movable member are of a one-piece construction of plastics.

3. A door latch operating device as claimed in claim 2, in which said stationary member is formed with an aperture in which one end portion of said first movable member is slidably received.

4. A door latch operating device as claimed in claim 3, in which said stationary member is formed with another aperture which has a boundary edge from which said second movable member extends.

5. A door latch operating device as claimed in claim 4, in which each of the hingedly connected portions is reduced in thickness.

6. A door latch operating device as claimed in claim 1, in which said third movable member comprises two substantially identical component parts which are associated with said first and second movable members in substantially the same manner.

7. A door latch operating device as claimed in claim 2, in which said third movable member is formed with a pin which is pivotally received in a slit formed in said first movable member.

8. A door latch operating device as claimed in claim 7, in which said pin is formed on the leading end of said third movable member.

9. A door latch operating device locking and unlocking a door relative to a fixed member, comprising:

a stationary member secured to the door;

a first movable member movable relative to said stationary member between a first position to cause the door latch device to assume its door lock condition and a second position to cause the door latch device to assume its door unlock condition;

a second movable member having one end hingedly connected to said stationary member; and a third movable member having an end hingedly connected to the other end of said second movable member and having the other end pivotally connected to said first movable member, so that the movement of said second movable member induces the movement of said first movable member, and vice versa;

wherein said third movable member is arranged with respect to said second movable member to always define therebetween an acute angle; and wherein said stationary member, said second movable member and said third movable member are of a one-piece construction of plastic;

wherein said third movable member is formed with a pin which is pivotally received in a slit formed in said first movable member, said third movable member including:

a leading end detachably engageable with a wall portion of said first movable member;

a convex outer surface slidably engageable with a flat surface formed on said first movable member; and a portion to which said pin is fixed, said portion being near said convex outer surface but away from said leading end.

10. A door latch operating device, comprising:

a stationary member having first and second openings, the axes of which intersect at an angle a first movable member slidably received in said first opening, said first movable member being movable between a first position to cause the door latch device to assume its door lock condition and a second position to cause the door latch device to assume its door unlock condition;

a second movable member having one end hingedly connected to said stationary member and being projectable into said second opening, said second movable member being swingable about the hinged portion between first and second positions; and a third movable member having one end hingedly connected to the other end of said second member and the other end pivotally connected to said first movable member, so that said first and second positions of said second movable member correspond to said first and second positions of said first movable member, respectively;

wherein said second and third movable members are arranged so that the movement of said second movable member can induce the movement of said first movable member, and vice versa, said second and third movable members always defining therebetween an acute angle; and wherein said first movable member is arranged so that when assuming said first position, the top thereof is fully received in said first opening, and when assuming said second position, said top is projected outward from said first opening.

11. A door latch operating device as claimed in claim 10, wherein said second movable member is arranged so that when assuming said first position, the outer surface thereof is flush with the outer surface of the stationary member at the position where the second opening is located, and when assuming said second position, said outer surface is deeply put in said second opening.

* * * * *